US007506606B2

(12) United States Patent
Murphy et al.

(10) Patent No.: US 7,506,606 B2
(45) Date of Patent: Mar. 24, 2009

(54) MARINE PAYLOAD HANDLING CRAFT AND SYSTEM

(76) Inventors: Robert Joseph Murphy, 11225 56th Pl. North, West Palm Beach, FL (US) 33411; Phillip Saunders Olin, 2230 NW. 7th Ave. Rd., Micapony, FL (US) 32667

( * ) Notice: Subject to any disclaimer, the term of this patent is extended or adjusted under 35 U.S.C. 154(b) by 384 days.

(21) Appl. No.: 10/563,349

(22) PCT Filed: Jun. 14, 2004

(86) PCT No.: PCT/US2004/019042

§ 371 (c)(1),
(2), (4) Date: Jan. 3, 2006

(87) PCT Pub. No.: WO2005/030571

PCT Pub. Date: Apr. 7, 2005

(65) Prior Publication Data

US 2006/0191457 A1 Aug. 31, 2006

Related U.S. Application Data

(60) Provisional application No. 60/484,753, filed on Jul. 3, 2003.

(51) Int. Cl.
*B63B 23/02* (2006.01)

(52) U.S. Cl. ..... 114/368; 114/242; 114/248; 114/253

(58) Field of Classification Search ..... 114/242, 114/246, 248, 249, 250, 253, 368
See application file for complete search history.

(56) References Cited

U.S. PATENT DOCUMENTS 3,448,712 A * 6/1969 Adams, Jr. et al. ..... 114/259
6,178,914 B1 * 1/2001 Axelsson ..... 114/368
6,474,255 B2 * 11/2002 Geriene et al. ..... 114/312

* cited by examiner

*Primary Examiner*—Lars A Olson
(74) *Attorney, Agent, or Firm*—Robert W Pitts

(57) ABSTRACT

A marine handling craft and system is intended for use in deploying, inspecting and receiving vessels and payloads to and from locations on, under, over or near water and wet soils in potentially turbulent aquatic or atmospheric conditions. The marine handling craft may operate as a robot, or deployed from a crane or boom on a mother ship or other platform or helicopter so that it can transport and mate and dock at various locations, such as supply ships or autonomous marine vessels, at a stand off distance to limit potential harm to valuable assets. A sliding fastener and track are included on the marine handling craft so that it can be tethered and lifted by a single line or cable, and so can be manipulated by a single crane or helicopter. The utility of the handling craft is not limited to the transport of payloads and it may function as a stand-alone vessel for various remote sensing purposes. Smart communication between the marine handling craft and other vessels or other nodes in a distributed computer network facilitates simultaneous, hierarchical and multi-tasking control of the craft and permits verification and inspection of payloads, which might otherwise cause damage when proximate to more valuable assets.

38 Claims, 10 Drawing Sheets

MARINE PAYLOAD HANDLING CRAFT AND SYSTEM

CROSS REFERENCE TO PRIOR CO-PENDING APPLICATON

This application claims the benefit of prior co-pending Provisional Patent Application Ser. No. 60/484,753 filed Jul. 3, 2003 entitled Boat Handling System.

BACKGROUND OF THE INVENTION

1. Field of the Invention

This invention is related to payload delivery, primarily to or from a ship or other marine vessel. This invention is also related to the deployment of a smaller vessel or payload combination and to its recovery. This invention is also related to the inspection of payloads, vessels, flotsam or any other article before bringing the payload or other article into proximity with a larger vessel or platform to prevent damage to the primary platform, such as a mother ship from which a smaller vessel may operate.

2. Description of the Prior Art

There is presently no safe, cost-efficient craft and system, which allows military and commercial ships or helicopters to deploy, service, maintain, retrieve and exchange data and payloads with smaller vessels. The trend in marine and aquatic military operations is one where large vessels will have an increasing need to deploy smaller vessels, particularly unmanned ones, for a variety of purposes. Further, safety requirements for naval assets in a climate of terrorist attacks, including chemical, biological and explosive threats, are such that systems are needed whereby a large vessel can safely handle, inspect and exchange data and materials with other vessels and payloads under a variety of conditions. Safety requirements for military and commercial applications are such that increasing the stand-off distance between large and small vessels is of major importance. It is often the case that large vessels are required to come into close contact with vessels of unknown origin and with cargo of unknown provenance. Using the USS Cole as an example, small vessels that may contain explosives and are closely-coupled with a larger vessel at the waterline can exact an extreme amount of damage, particularly below the waterline, because of hydraulic properties. As the distance between a smaller vessel and a larger one increases, explosive forces and the damage they cause decrease geometrically and rapidly to insignificance. It is desirable to have a craft which will increase the stand-off distance of larger vessels from smaller ones, which may contain unknown hazards and personnel.

The advent of new types of remotely-operated systems dictate entirely new types of craft which will operate under extreme conditions, including but not limited to speed, sea state, wide payload variety, weather, darkness, and enemy fire. New types of remotely-operated vessels operate at, above and below the water's surface. They come in a variety of types and sizes, from ounces to tons. The trend is to smaller vessels. Further, types of hazards used as weapons can range from ounces, such as biological and radiological hazards, to tons, such as fertilizer explosives. Again, the trend for intentionally-deployed hazards is improving technology with decreased size with increased effectiveness.

The use of separate craft for each new vessel employed by military or commercial means is highly undesirable. Large ships are expensive, and their design and manufacture is a lengthy process. The large ship duty cycle can run for decades, however smaller vessels change much more rapidly, and a new design can be in service within months or years. Small vessel obsolescence and replacement takes place over a much shorter period than for larger vessels. It is highly desirable to have an inexpensive small craft which is a physical and data interface between large and small vessels.

For many, if not most, operations employing such smaller vessels, it will be necessary to deploy or recover the smaller vessel from a primary vessel or platform. U.S. Pat. No. 6,178,914 discloses a method of launching a small vessel, such as a rescue or working boat, from a larger ship while the ship is under way. A floating cradle is towed from the larger ship, and the boat or smaller vessel is launched or recovered while positioned in the floating cradle. Rudders are provided for steering the floating cradle via a yoke. However, there appears to be no suggestion that the floating cradle could be used in other than a towed capacity or for military and security operations, or as a smart platform for sensors, or for operating independently, i.e. untethered as a standalone craft. The cradle is "dumb", and has no sensors, computers, or data links. The system employed in that patent also requires two cranes and would not provide for center of gravity adjustment under different load conditions. There no provision for handling a variety of auxiliary vessels or payloads, including personnel. There is no contemplation of operations either from platforms other than ships, or when absent a mother vessel. The floating cradle is positively buoyant and not capable of submerged operation, lacking trim tanks and diving planes. This towed sled is uni-directional along the mother ship's course, with marginal freedom to move laterally. It is only capable of launching and recovery from the rear. The coupling mechanism in U.S. Pat. No. 6,178,914 is particular to a specific vessel and does not contemplate multipurpose use or remote operation.

Physically contacting or deploying and recovering a small vessel or objects fixed to the shore or bottom is problematic due to the physical characteristics of the water and vessels, particularly when the vessels are of disproportionate size. Water, a fluid medium, has current, tides and wave motion at the air/sea interface which regularly manifests itself as periodic, generally periodic, or irregular and chaotic. The motion significantly decreases as a vessel submerges. The mass and displacement characteristics of a larger vessel compared to a smaller one exacerbate differences in motion. While two vessels may be in the same body of water, the ambient conditions will often be different even at proximal locations. While a large vessel of 1,000 tons might roll gently at a certain sea state, a smaller vessel might rise and fall, pitch and roll at several hundred percent of its length, height or beam. Further, the relative motion between large and smaller vessels is localized, affected by the vessels themselves and can be significantly affected by any recovery device or mechanical connection between a smaller or larger vessel. It is highly desirable to have a "smart" payload handling craft, with propulsion and control surfaces, which can inspect cargo and compensate for the differences in the relative motions between larger vessels and payloads. The handling craft should be capable of operating at, above, and below the water's surface. Such a vessel should have a large operational envelope for efficiency and safety purposes.

Military establishments use traditional, non-modular systems, like "A-frames" or davit/block and tackle systems because there is no alternative. Some very expensive systems like the US Navy's Remote Mine Hunting System, have dedicated handling systems which are completely and intentionally exclusive to a particular device. Many expensive, but small military vessels, such as smart torpedo-like devices, are simply handled by men in rubber boats. Rapidly changing technology dictates that there is a need for a new craft to handle a variety of payloads including craft, but handling systems and craft must remain backwards-compatible to legacy systems.

SUMMARY OF THE INVENTION

This invention is related to payload delivery involving water, land and a variety of platforms in the transport logistics loop, where marine vessels and aquatic or near-aquatic or wet soils may be involved, and in particular to a craft for handling, transporting and transferring payloads, including cargo, supplies, personnel, equipment, ground tackle, and other auxiliary vessels to and from ships, docks, marine platforms and shore. This invention is a marine payload handling craft and a system for its use. In addition to use entirely in a marine environment, this craft and system are also suitable for use in transferring payloads between marine and aerial platforms as well as between marine and land platforms. The marine handling craft operates in a variety of modes: mechanically hard-coupled to a ship or other platform, in a tethered mode, including, but not limited to: a dock, ship or helicopter, or, operating untethered as a stand alone craft on land, on, or under, the water. It may be parachute-deployed. It is capable of being operated manually, remotely by a distributed computer networking system, or autonomously via computer, as a robot, with pre-programmed navigational input, in advanced embodiments. It is capable of operating at, above and below the water's surface. The instant invention, even in its most basic embodiment, is capable of handling, but not limited to: inspection, analyses, and safe transport of payloads from land to ship and vise versa, or retrieving flotsam, jetsam, lagan, flora, fauna, humans or high speed, autonomous vessels.

This invention is equipped with an embedded computer and telemetry system capable of: ship to ship and ship to shore networking; autonomous piloting, remote-sensing of payloads and the environment, and transmitting pre-processed data from it's sensors. It can handle payloads, at, above and below the water's surface, with speeds that are greater or less than that of a mother ship. It is suitable for military, passenger and commercial vessels, and the craft's handling system can be integrated with other objects like oil platforms or docks or land masses. It is capable of integrating modular hard points and bolt-on devices for handling cargo, aerial vehicles and personnel at, above and below the water's surface. The craft's computer, with sensors and computerized control surfaces, is capable of detecting and predicting roll, pitch, and yaw conditions. The invention's control surfaces can compensate for roll, pitch, and yaw, facilitating the handling of payloads gently, minimizing shock [G-forces], vibration and relative motions between payloads and desired landing points.

This invention is a computerized handling craft with high speed open-sea operational capacity, able to handle vessels, personnel, equipment and cargo, referred to generally as "payloads" from other ships while docked or underway, or to handle payloads from dock or shore mounts. In advanced embodiments, an articulated, hydraulic, air or electrically-powered boom and a motion damping, range-extending umbilical are combined with the marine handling craft. This boom would facilitate "smart" and "flexible" forcing and locking systems, which can lock and release the craft from auxiliary vessels or payloads, and the locking systems can attach the craft to a boom, tether or crane. These locking systems may use closed-circuit air, water, electromechanical and/or hydraulic pressure, or use flows and vacuums of ambient air and water generated during operation to stabilize the craft and facilitate handling payloads under a variety of marine and atmospheric conditions.

The system, according to this invention, integrates passive and/or computerized systems with active mechanical means. The invention can compensate for or dampen relative motion between the docking area of the craft and payloads. Marine handling craft system components can also be linked for data transfer or for a payload, personnel or fuel exchange. This craft can collect, analyze and transmit data in a variety of modalities from a variety of sensors ranging from X-rays of payloads to sensors for ambient climatology.

The marine handling craft, in its basic embodiment, is a tethered catamaran-like design capable of operation at, above or below the water's surface. It may use ballasting for positive, negative or neutral buoyancy. Control surfaces, which contact air and water, are, in some embodiments, part of the structure, which serves dual purposes and vectored air or water may be used to facilitate payload handling. This marine handling craft may be man operated, remotely-operated or operate entirely autonomously via an on board computer. The design is scalable to various ship or boat sizes and is modular. In most embodiments, multiple instances of the craft are capable of nesting within each other, like grocery store shopping carts, which conserves shipboard cargo space.

The handling craft can be ganged to receive more than one small vessel and a single craft can be configured to fasten to others and adjust accordingly. The marine handling craft may be programmed to avoid collisions or grounding. Some examples of collision hazards include: other vessels that are being retrieved, ships, bottom ground under the vessel, dry land, flora or fauna and other marine handling craft. The marine handling craft design may be practically applied to retrieve craft of different sizes, and is especially suitable for use with vessels of under thirty-five feet. It is suitable for ship-to-ship, ship-to-dock or ship-to-shore applications. When in a tethered "sled" configuration it may contain propulsion systems or trim/leveling control surfaces like tabs, fins and rudders.

This marine handling craft is a major improvement over other existing systems for handling payloads with advantages including ease of operation, extending the envelope for large ships retrieving payloads and increased safety to ships and crew, protecting both ships and crew from mechanical injury, explosions and biohazards. The scalable design is adaptable to a multitude of military and commercial ships and docks and may be mounted on vessel deck, hull, shore, barge or buoy.

An umbilical lift cable that is attached to a boom on the mother ship, helicopter or other platform can be reeled in or out. The umbilical can transfer fuel, electrical power or data, and mechanical force for towing and lifting the craft and its payloads. One end is attachable to, and detachable from, a uniquely configured sliding attachment, which is part of a positive traction slide rail mechanism on the marine handling craft. During pre-dock and docking, the lift cable/sliding attachment may be positioned at the bow (nose or front) of the marine handling craft.

The center of gravity for the invention will vary, depending upon the payload, and it is also desirable to adjust the angle of attack with the water. Level [trim] sensors in the invention can compensate for changes in force vectors [wind, water] or cargo shift affecting the center of gravity. The compensation used to maintain any particular attitude to suit the payload and handling thereof includes computerized manipulation of control surfaces, manual or computerized trim tank adjustment and gyroscopic stabilization.

During the docking, a locking mechanism engages and locks, the cable/sliding attachment travels up the positive traction rail mechanism to a point centered over the center of gravity of the marine handling craft and contents, or offset from the center of gravity if desired, to facilitate planing, diving or minimizing wave action. The cable sliding attachment then locks in place and the assembly can be lifted aboard ship. This traveling or slide mechanism can be passive or actively driven by electrical, hydraulic or pneumatic means.

Marine handling craft, according to this invention, enable aquatic military operations to be conducted more rapidly. Benefits include highly-increased efficiency, decreased exposure to enemy fire, reduced stress on systems and payloads, inspection of payloads, covert operations if desired, and decreased susceptibility to weather. This marine handling craft has built-in redundant systems for retrieval and can operate in modes of various positions and towed, operating remotely, or autonomous operation which allow it to retrieve disabled smaller vessels from larger ones and to serve as a system to collect flotsam, jetsam, lagan, debris, buoys, humans, or aquatic flora and fauna.

"Lagan" is defined as goods thrown into the sea with a buoyancy system attached so that they may be retrieved again . . . as opposed to "flotsam" and "jetsam". As robotics and marine sensors progress, lagan is becoming an increasingly important category of devices being deployed, handled, serviced and retrieved in commercial, military and scientific applications. There is often no need for dedicated hardpoints and dogging systems for small, computerized floating devices. Personnel may or may not be required to handle lagan, which may be done by robotic arm or other means.

The multiple sensor & transmitter system on the marine handling craft in advanced embodiments serves to facilitate tracking, analyzing, mating and securing items that will be retrieved from a ship connected to the marine handling craft. It may also be augmented with redundant computer and telemetry systems on board the vessel or device to be retrieved. Usable data transmission links can either be wired, use optical fibers, or be wireless, for example electromagnetic, infrared or laser. Sensors located on the marine handling craft may be used in the retrieval process for positioning, mating and retrieval. They have multiple purposes and may be used to inspect vessels, refuel, materials, equipment, flora and fauna of unknown origin. Sensor data may be analyzed either on-board, remotely, on shore or autonomously, and then compared with data stored in the marine handling craft computer or remote data bases via internet. Redundancy in telemetry compensates for, as one example, intentional electromagnetic interference, jamming or data "hacking", or ambient interference such as solar storms, other EM data systems in the area. Redundant telemetry systems and data streams allow cross-checking of data stream validity.

The benefits of this invention include, but are not necessarily limited to the following operations and capabilities, many of which may not be readily apparent to prospective users and those skilled in the art.

When hard-coupled or coupled by umbilical, secure, non-wireless data linking can provide virtual unlimited bandwidth and preserves wireless bandwidth for military battle space and commercial applications, and minimizes interference.

Remote refueling, servicing and hazardous payload exchange are possible at a distance from valuable marine assets and personnel.

Sick personnel or other personnel can be transported for maintenance or security and a variety of other purposes. Personnel and payloads can be transported ship to ship or ship to shore.

Lethal and non-lethal anti-personnel devices for threat elimination can be employed on the marine handling craft.

The craft can contain tanks and spray nozzles for materials including, but not limited to: disinfectants, fire retardants, fluorescing ligands [analytical/multi-purpose] and protective coatings.

Open architecture and cross-service deployment can be employed to increase the number of environments in which the marine handling craft system can be employed by multiple users; The invention is part of a distributed computing system capable of being operated by more than one user in a command hierarchy.

The marine handling craft can be used for controlling, reeling and unreeling devices, [including but not limited to: sensor "eels", containment-booms, data cables, ground tackle and net deployment.

The marine handling craft can be used for examination, disarming and neutralization of devices which may be applied to potentially dangerous payloads by employing such subsidiary components as robotic arms, X-ray systems, sniffers, neutron activation/gamma backscatter or acoustic imaging systems for collecting data and EM pulse coils, high pressure water jets, mechanical shears, saws and rams, explosives or other assembly and disassembly tools. Also, deactivating or destructive devices for examination and neutralization of recovered items can be employed if required. As an inexpensive robotic sensing and manipulating device, the invention is "expendable" as compared to, for instance, a Navy frigate, which is not.

BRIEF DESCRIPTION OF THE PREFERRED EMBODIMENT

Figure 6A:
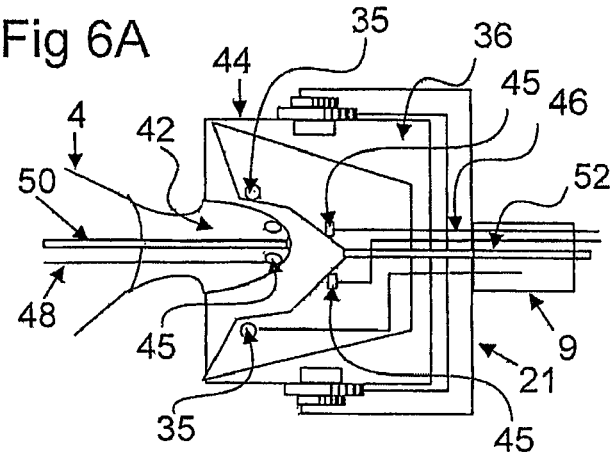
Figure 6B:
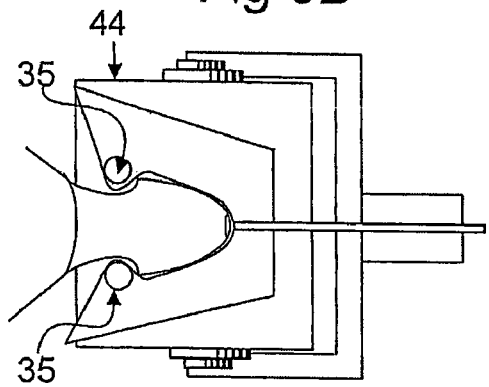
Figure 6C:
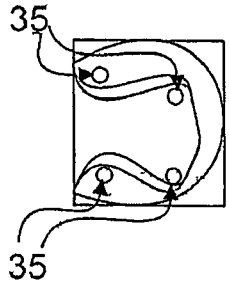
Figure 6D:
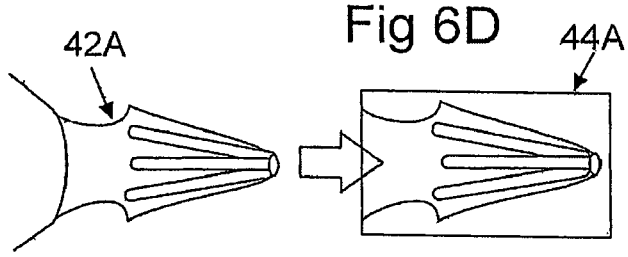
Figure 6E:
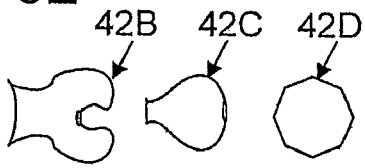

FIGS. 6A and 6B are schematics of complementary locking devices that are employed to dock the marine handling craft to an auxiliary vessel. FIG. 6C is a schematic of a similar version in which both male and female locking devices expand during mating. FIG. 6D is a view of locking devices having keyed fins so that only unique complementary locking devices are engagable. FIG. 6E shows several alternate configurations for uniquely shaped locking members.

Figure 7:
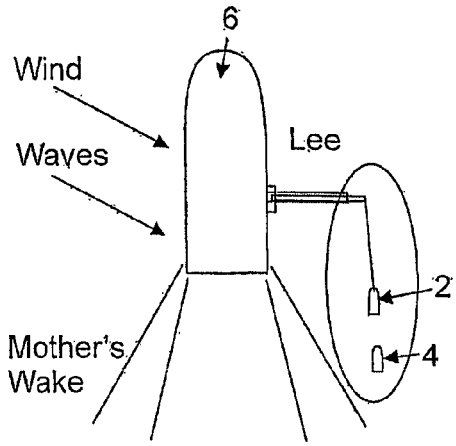

FIG. 7 shows an optimal recovery condition, from a mother ship when it is underway.

Figure 8:
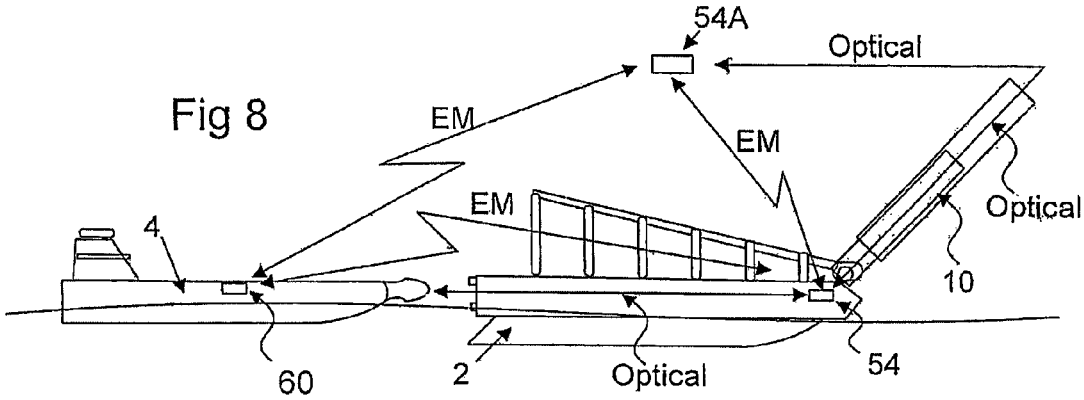

FIG. 8 is a schematic of a marine handling craft system and the manner in which computers on the marine handling craft, the auxiliary vessel and the mother ship can be networked for control and security purposes.

Figure 9:
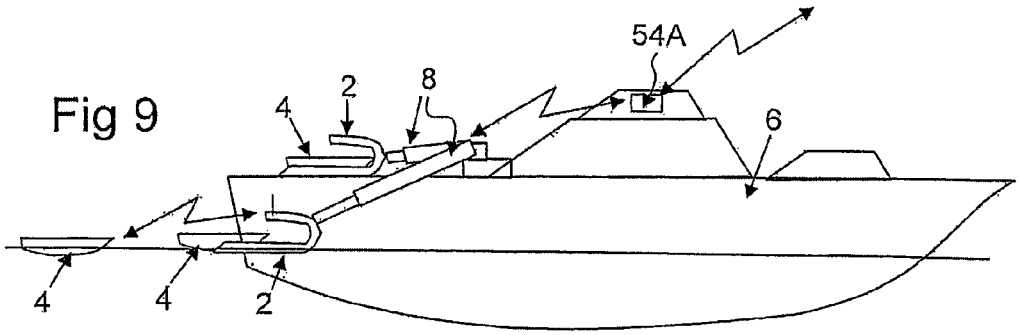

FIG. 9 is a schematic of a mother ship showing how a single crane can be used to hoist an auxiliary vessel docked to a marine handling craft onto a mother ship with the mother ship being in communication with the other vessels.

Figure 10:
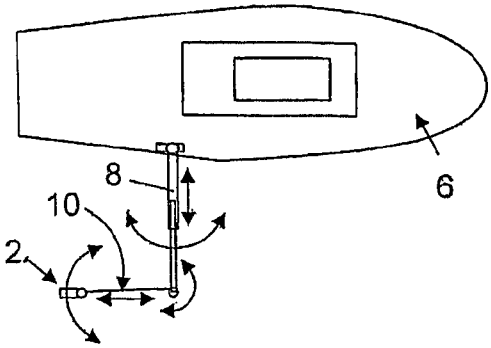

FIGS. 10 shows the manner in which a marine handling craft can be maneuvered while being towed by a single crane on the mother ship.

FIGS. 11A-E show the manner in which control surfaces on a marine handling craft can be used both to control the attitude of the marine handling craft and serve as a floor on which an auxiliary vessel can be positioned, as well as being used to retrieve flotsam or safely handling objects of interest near a primary ship or other platform.

Figure 12:
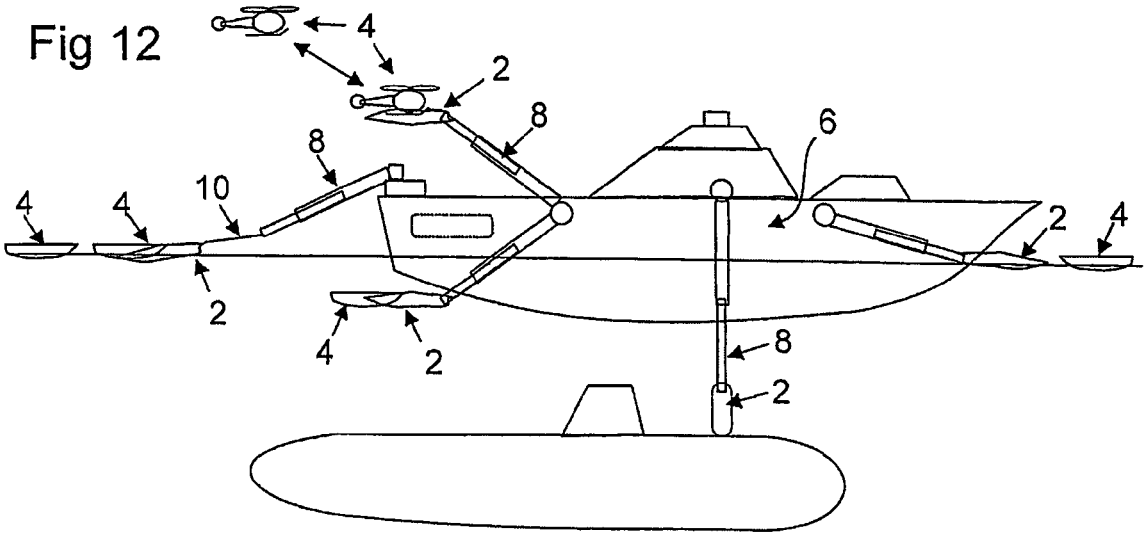

FIG. 12 is a view showing the use of a marine handling craft in accordance with this invention used in a number of different operations, including surface and subsurface operations.

Figure 13A:
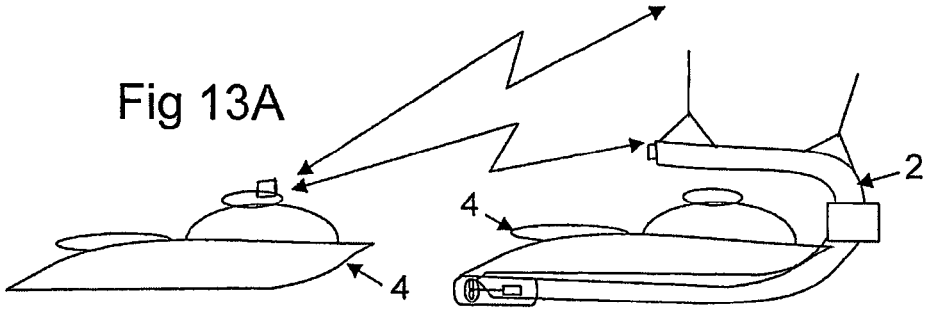
Figure 13B:
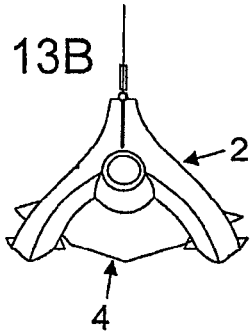
Figure 13C:
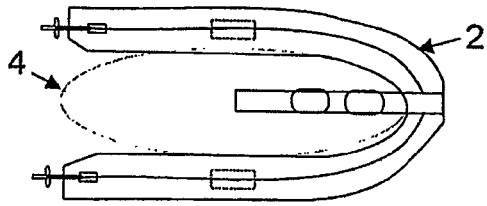

FIG. 13A-13C are views of an alternate embodiment of a marine handling craft mateable with a personal watercraft.

Figure 14A:
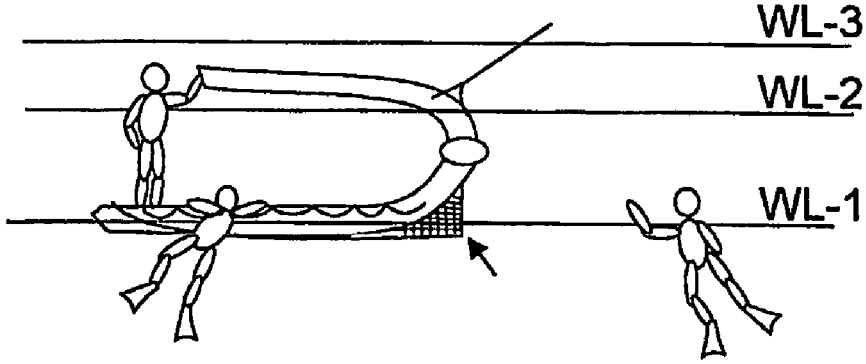
Figure 14B:
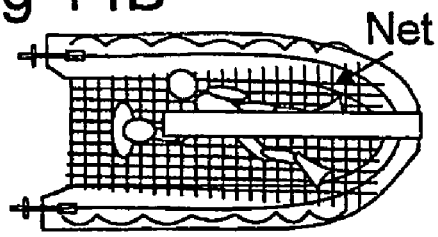
Figure 14C:
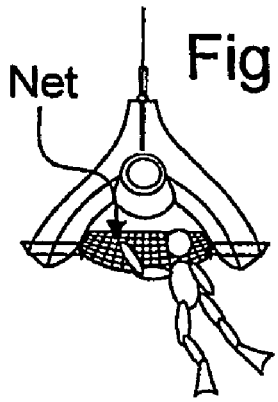

FIG. 14A-C are views showing how a marine handling craft can be used to deploy or recover a diver, a swimmer or rescue someone lost overboard.

Figure 15:
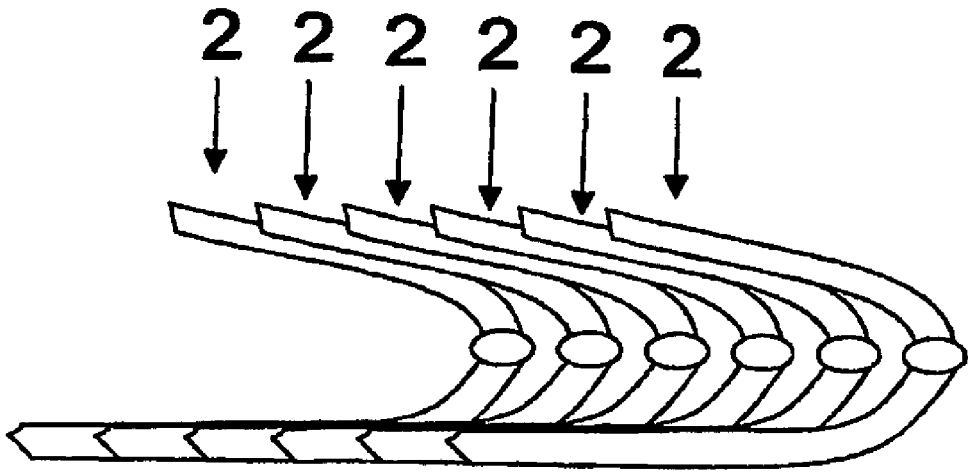

FIG. 15 shows the manner in which multiple marine handling craft can be stacked for storage.

Figure 16:
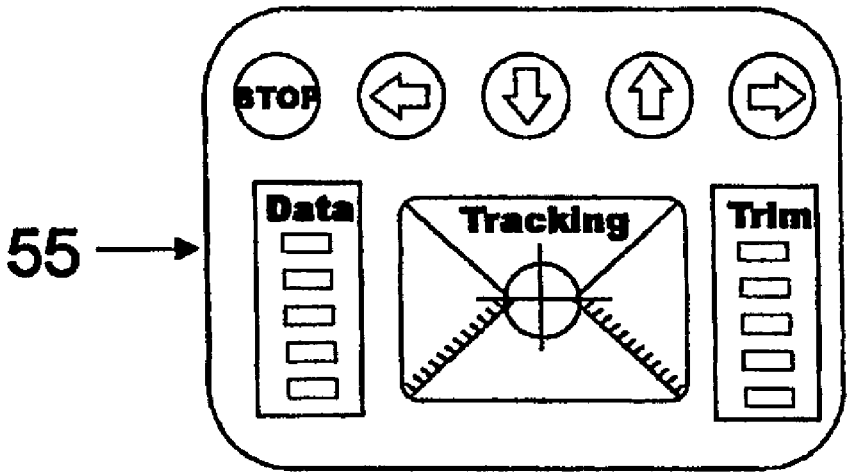

FIG. 16 is a view of a representative control panel that can be used by personnel onboard the marine handling craft or remotely from networked computers.

Figure 17:
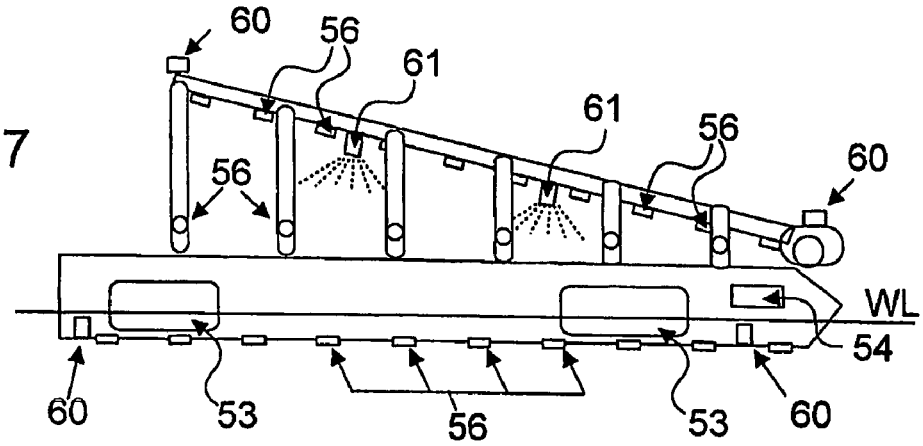

FIG. 17 is a view of numerous sensors, sprayers and computers mounted on a marine handling craft.

Figure 18:
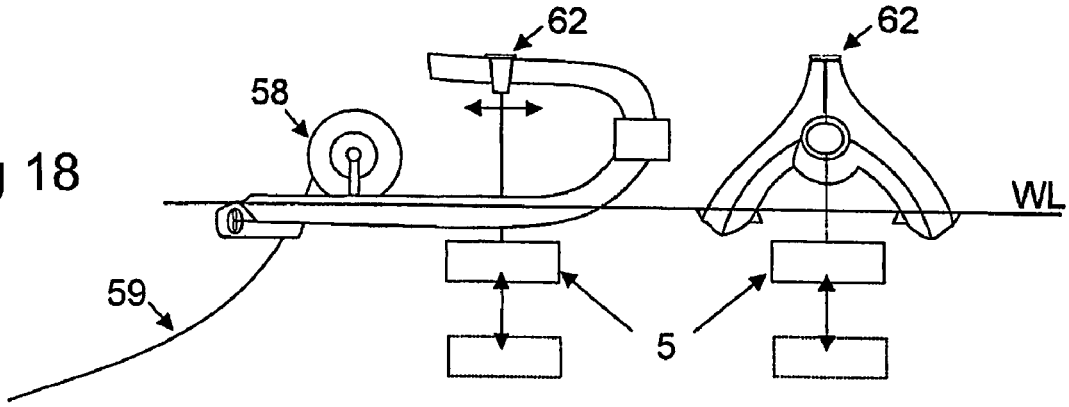

FIG. 18 shows a marine handling craft used for deploying or retrieving cables and for deploying and recovering specific payloads buoyed by water.

Figure 19:
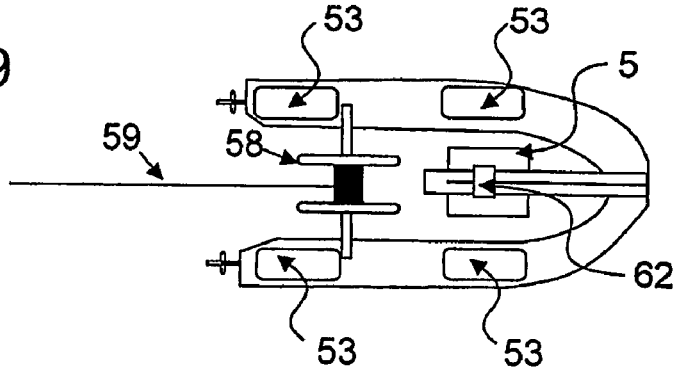

FIG. 19 is a plan or top view of a marine handling craft used for deploying or retrieving cables and for deploying and recovering specific payloads buoyed by water.

Figure 20:
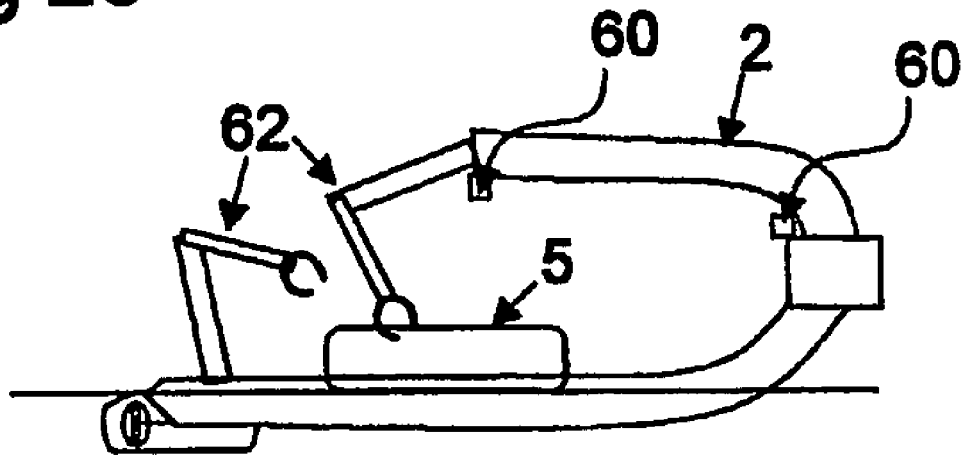

FIG. 20 shows two of many positions at which robotic arms can be located on the marine handling craft to sense and manipulate docked craft or payloads.

DESCRIPTION OF THE PREFERRED EMBODIMENTS

Small autonomous vehicles or robots are a new, major category of vehicle, whether suitable for use on land, in the air and on water, both on the surface and sub-surface. There is an increasing need for air/land/water launch and recovery of smaller vehicles from larger ones, requiring speed and safety. Aquatic environments have an unusual set of conditions and a multipurpose, modular "interface" is needed to deploy and handle these devices. Further, some of these smaller devices may change their shape, and size as a function of their missions, e.g. inflating, deflating, or extending/retracting wings or control surfaces. The marine handling craft anticipates the near future when virtually all devices will be web-connected, and that it will be desirable for a craft to be multi-purpose, modular, equipped with sensors, network connected, and "smart".

The marine handling system according to this invention includes mechanical systems for docking, mating and hoisting payloads to a larger vessel, shore-mounted crane or helicopter. The marine handling craft 2 is designed to handle payloads collected at the stern, along side or at the bow. The marine handling craft in some embodiments is connected to a custom crane with custom devices, but even advanced embodiments can deployed with a conventional crane, A-frame or davit system enabling retro-fit to existing legacy vessels. The invention can be handled by a helicopter, taken from shore, and then placed in the water for retrieval by a mother ship, or placed on wet soils that will not carry wheeled or tracked vehicles for payload exchange with personnel on foot.

In the basic embodiment, the marine handling craft 2 can be deployed from a mother ship and reeled out. With the attachment point adjusted towards the bow, vectors are maximized for planing and towing stability. In the tow mode, in its basic form, the marine handling craft 2 tracks along with a mother 6 behind a crane 8, as a slave, preserving the invention's power and/or fuel. As the marine handling craft 2 is reeled towards the vessel, the attachment point is adjusted back to the combined center of gravity of the marine handling craft 2 and its payload, facilitating a level lift, with the keel of the marine handling craft 2 parallel to the water, or other desired orientation, whether loaded or unloaded. This adjustment may be programmed or done "by eye" by operators on a mother vessel, the craft itself, on board a vessel being handled, or other location via telemetry.

A basic marine handling craft 2 is used with an auxiliary vessel 4 transporting persons, small vessels and cargo. It can operate freely, but it is also configured to be towed, and be lifted from the water along with payloads, either by a single crane hook or hard coupled and uncoupled to and from a crane boom with a fastening device.

This marine handling craft 2 in its simplest embodiment is unpowered. In its most complex embodiment, even while tethered, it is designed to have six degrees of freedom, in the air, at the water's surface, or under water. In advanced embodiments, it is self-propelled, equipped with a gyroscope 37, control surfaces and sensors, plus other features, and functions as a server for a local area network facilitating handling and other information regarding payloads.

Figure 1:
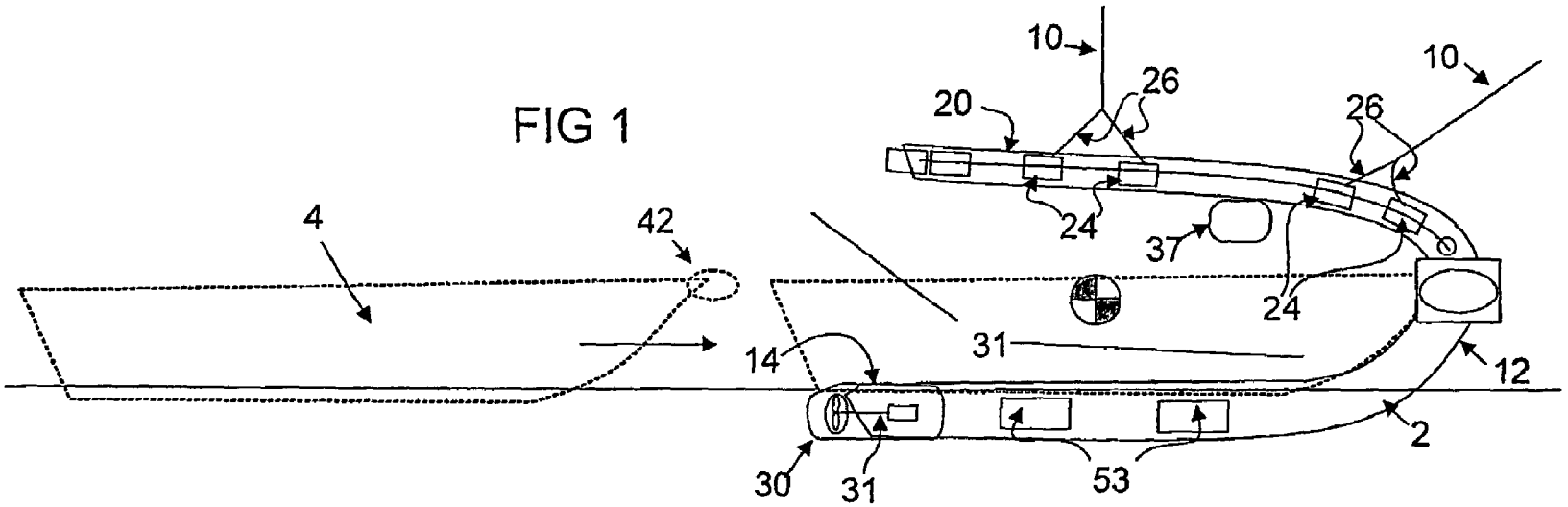
FIG. 1 is a side view showing the manner in which an auxiliary vessel can be mated or unmated from a marine handling craft, which is in turn attached to a mother ship via a tether or umbilical.
Figure 3:
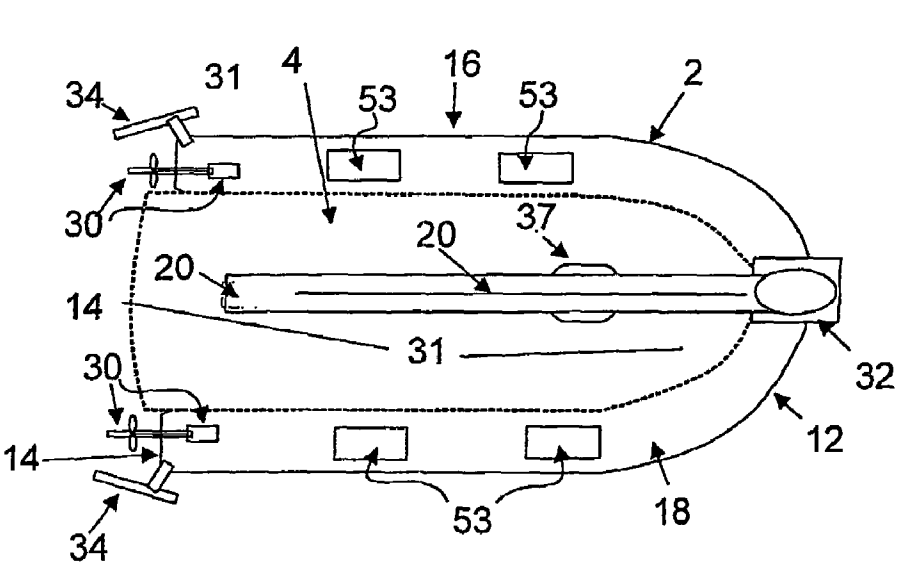
FIG. 3 is a plan view of the marine handling craft shown in FIGS. 1 and 2, with the docked auxiliary vehicle mated and docked with the marine handling craft.
Figure 2:
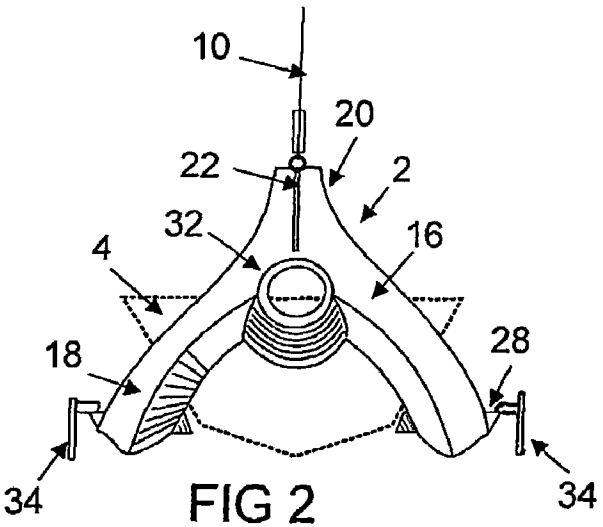
FIG. 2 is a front view of the marine handling craft of FIG. 1, with a docked auxiliary vehicle shown in phantom.

A basic embodiment of this invention is depicted in FIGS. 1-3. FIG. 1 shows a marine handling craft 2 and an auxiliary or supply vessel 4 that can be mated and docked to the marine handling craft 2 to recover or transfer the contents of the auxiliary or supply vessel 4 to a mother ship or vessel, which can tow the marine handling craft 2 by a tether 10 that extends from a crane, boom or davit located on the mother ship. The auxiliary or supply vessel 4 can be deployed from the mother ship using the marine handling craft 2 or it can be captured and recovered by the marine handling craft 2 so that the auxiliary vessel 4 and its contents can be transferred to the mother ship 6. As depicted in FIG. 1 the auxiliary vessel 4 can approach the marine handling craft 2 from the stern 14 or it can be released from the marine handling craft 2 when deployed from the mother ship.

The marine handling craft 2 is a floating structure that includes at least two spaced apart planing pontoons 16, 18 that extend from the bow 12 toward the stern 14. In this catamaran design the pair of pontoons can include a personnel deck and cradle system so as to form a containment area 31 between said pontoons. In this configuration, the planing pontoons 16, 18 form this compartment 31, which may approximate the negative shape of the specific type of payload to be collected, and serve as forks to lift the payload from the water. In FIGS. 1-3, this payload comprises an auxiliary vessel 4, which may be a supply vessel or an autonomous surface vehicle. The compartment 31 is open at the stern 14 and is partially bounded at the bow 12, where the two pontoons 16, 18 merge. Each pontoon extends upwardly at the bow 12 so that the pontoons will be above the waterline in the configuration shown in FIGS. 1-3. The configuration serves a funneling effect for powered payloads, which enter from the stern, but the bow also has the capability of funneling if desired. If the direction of the marine handling craft 2 is reversed, either under its own power or the power of a mother vessel 6 if hard-coupled, the stern presentation can serve as a scoop for passive payloads, in the air, as well as at or below the water's surface.

A marine handling craft 2 of this type can include straight line hull sections for modular fabrication and assembly and for enlarging or shortening width or length, or for geometrically reconfiguring to conform to particular requirements of particular payload shapes.

This craft has an aerodynamically and hydrodynamically shaped bow, keel and cradle sections for directional stability and minimal presentation to the forces of wind and water, which are also configurable to facilitate vectoring the craft. As will be subsequently discussed in greater detail, this craft 2 can also have trim and ballast liquid storage tanks mounted inside the pontoons 16, 18 for positive or negative buoyancy or trim functions, and the multiple locking mechanisms will have security functions and facilitate handling.

This marine handling craft 2 is capable of operating in either forward or aft directions, and an auxiliary vessel can enter it at speed from the rear, or, if the craft is rotated 180 degrees, it can track and "scoop" propelled or non-propelled mechanisms or flora or fauna. When robustly hard-coupled to a boom, there is no need for control surfaces on the craft. When tethered or free-running in reverse, the directional properties of the craft may be less than optimal, but the onboard computer can operate servos and control surfaces to provide tracking stability.

An upper track 20 extends from the bow 12 generally above the centerline of the compartment 31, evenly spaced between the two generally parallel pontoons 16, 18. The rear end of the track 20 is open so as not to obstruct the compartment 31 and leave adequate clearance for entry and exit of an auxiliary vessel 4 or for collection of floating debris or suspicious objects. The tether line 10 connecting the marine handling craft 2 to the mother ship or vessel 6 engages this track 20. When the marine handling craft 2 is towed, the tether 10 may engage the marine handling craft 2 at its forward end adjacent the bow 12. Engagement between the tether 10 and the track 20 can be moved aft to a position substantially above the combined center of gravity of the mated and docked marine handling craft 2 and auxiliary vessel 4. In this position, the tether is in position to lift mated vessels or payloads from the water surface onto the deck of the mother ship, a platform or land. Alternatively, the mated vessels 2 and 4 can be lowered from the ship to the water with the tether 10 engaging the track 20 in this position. With a hoist line positioned over the combined center of gravity, the marine handling craft 2 and its payload can be raised and lowered for an aircraft, especially to or from a helicopter. This track 20 is especially useful when the marine handling craft 2 is used with an auxiliary vessel or supply ship, which acts as a means for transferring supply payloads to and from a ship, whether at rest or underway. Since the loading of the auxiliary supply vessel 4 cannot be assumed to be constant, the alignment of the tether or cable 10 with the combined center of gravity of the marine handling craft 2 and the auxiliary supply vessel 4 can be modified.

Figure 5A:
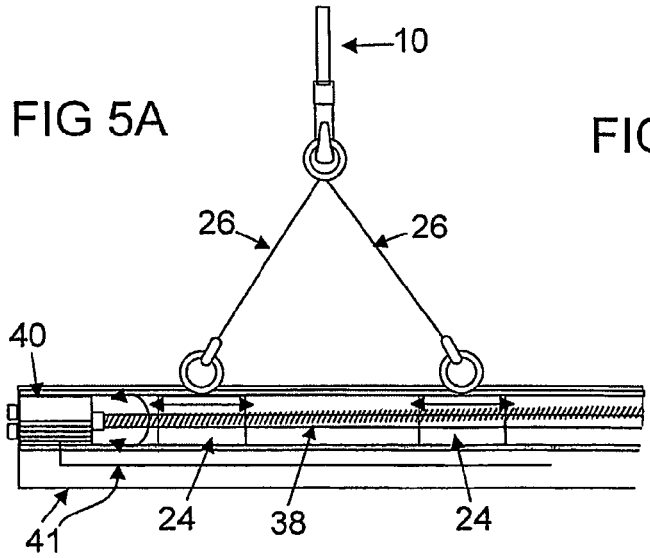
FIG. 5A is a side view of a mechanism for advancing traveling fastener blocks that are employed on the marine handling track for adjusting the position of the tether extending between the mother ship and the marine handling craft.
Figure 5B:
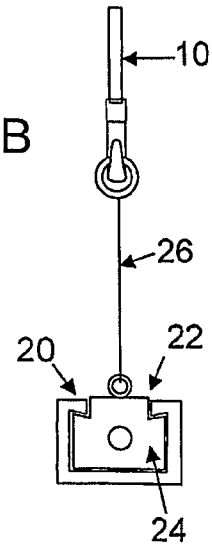
FIG. 5B is an end view of this same mechanism.

In the preferred embodiment, the track 20 includes an upwardly open channel 22, which extends from a position adjacent the bow 12 aft toward rear end of the track 20. This upwardly open channel 22 provides clearance for two auxiliary lines 26, which merge and are attached to the tether 10 above the track 20. Each of these two auxiliary lines is affixed to a separate traveling fastener block 24. The blocks are interior-threaded, and blocks may exterior-textured to allow ratcheting and facilitate locking under load. This pair of traveling blocks 24 is confined within the track 20 below the channel 22, with the track sides forming the channel 22 trap these traveling blocks 26 in the track 20. When the tether 10 is to be attached adjacent the bow 12 of the marine handling craft 2, these traveling blocks 24 are positioned adjacent the forward end of the track 20 and adjacent the bow 12. As shown in FIG. 1, the traveling blocks 24 can also be moved rearward to a position above the center of gravity of the two mated vessels 2 and 4 so that they can be hoisted or supported from a crane on the mother ship. The traveling blocks can be moved between the two positions shown in FIG. 1 by a number of conventional means. In the basic embodiment of the device, shown in FIG. 5, a linear actuator/threaded rod or strap 38 moves the tow point aft to make it a lift point over the craft and payload combined center of gravity. An alternate embodiment, especially if and when hard-coupled and/or when gyro-stabilized, could use one lifting block. The threaded rod 38 going through the blocks 24 is perhaps the simplest method, but a chain, strap, toothed belt, hydraulic/air powered actuator or similar may be used to move the lifting blocks inside the channel, which can accommodate complex curves.

A more basic marine handling craft embodiment is "dumb", and the traveling blocks may be adjusted by rotating a threaded rod with a hand crank or a portable electric drill. A motor 40 may be added to the rod and run from an operator on the auxiliary vessel, an auto-leveling computer on the marine handling craft the vessel; or by an operator on shore or a mother vessel. The power supply lines 41 may be remotely controlled by relays. An operator on a mother vessel or on shore or elsewhere would adjust for the center of gravity by "eye", using a remote control device.

In the preferred embodiment, there are no side struts. Side struts limit access for purposes including, but not limited to: payload loading, unloading, maintenance and covering. Without side struts, there is strain on the bow of the craft, but modern composite materials, such as polyester or epoxy-reinforced glass or carbon fiber, can handle the load easily. These modern, composite materials are flexible and reduce strain on both the payloads and the mother vessel. Additionally, there are accessibility, safety, stability and drag considerations, which make side struts undesirable for most applications. In this embodiment, the pontoons 16, 18 and the upper track 20 form three separate beams extending essentially from a common juncture at the bow of the marine handling craft 2. In addition to providing a rearwardly open compartment 31 into which auxiliary vessels 4 can enter or exit, this open rear configuration also permits stacking multiple marine handling craft 2 for storage and transport as shown in FIG. 15. These beam-like structures will also provide for attachment of supplemental components, such as nets, cables and surveillance and inspection equipment as will be subsequently discussed in greater detail.

The embodiment of FIGS. 11A-E shows a track that is supported by side struts 64. In some embodiments, depending on the application, side struts or ribs way be employed for a variety of functions, including, but not limited to eliminating stresses on the bow; supporting camouflage or weather covers; functioning as control surfaces; and mounting of transducers or sensors as shown in FIG. 14C.

Figure 4:
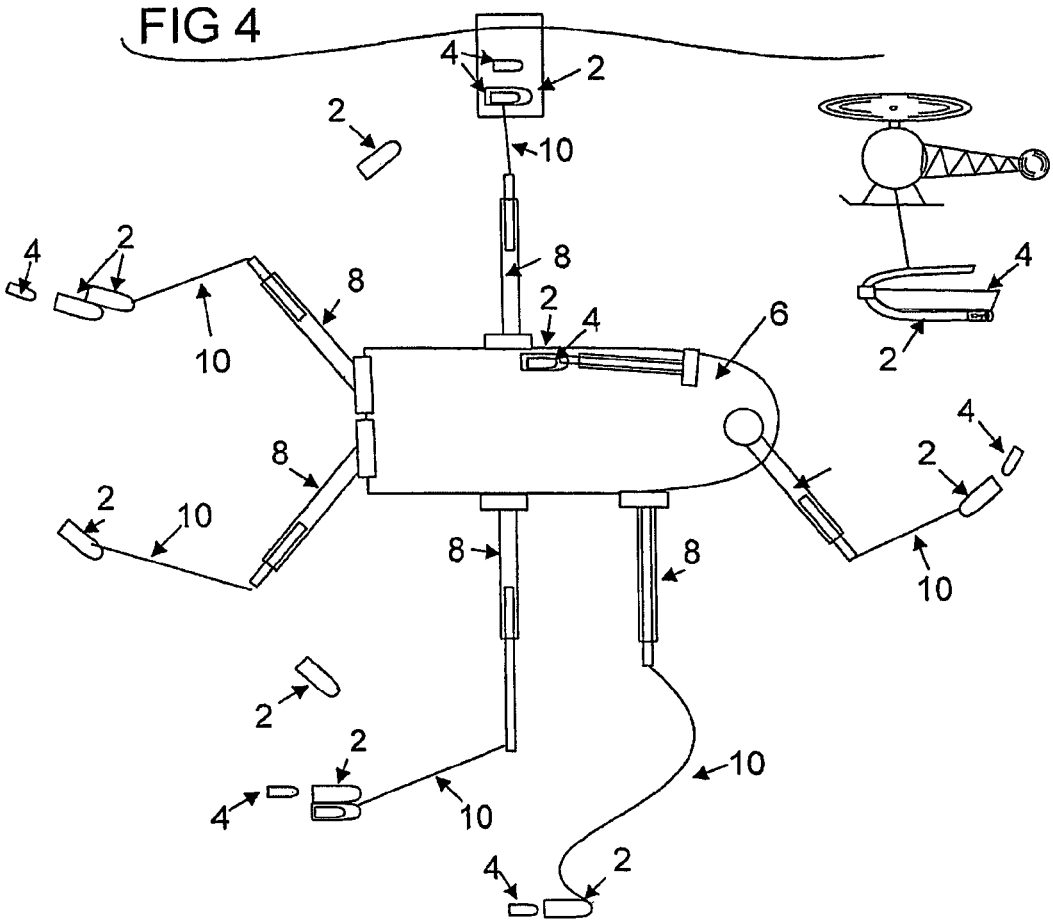
FIG. 4 is a plan view schematic showing how the marine handling craft shown in FIGS. 1-3 can be employed with individual cranes or booms located at various positions on a mother ship or attached to a helicopter.

The track 20 and traveling blocks 24 provide a mechanism in which the marine handling craft 2 can be attached to the mother ship only by a single tether or bundle of lines all acting together on the marine handling craft 2. A significant aspect of this approach is that the marine handling craft 2 can be supported, controlled and towed by only a single crane 8 on the mother ship 6. Use of a single crane, acting as the main attachment point on the ship means that the marine handling craft 2 can be deployed at any position on the ship where a standard crane or suitable davit is located. Assuming that sufficient cranes or hoisting mechanisms are available on the mother ship, dock or other platform, the auxiliary or supply vessels can be deployed and recovered from many positions on the mother ship 6. FIG. 4 is a schematic showing potential forward, aft and side deployment of the marine handling craft 2 attachable to existing cranes 8 on the mother ship 6. This means that use of the marine handling craft 2 does not require any significant modifications to or retrofit of the mother ship, and multiple cranes are not necessary to deploy auxiliary or supply vessels 4 or to collect auxiliary vessels 4 or other articles from the sea.

Figure 11A:
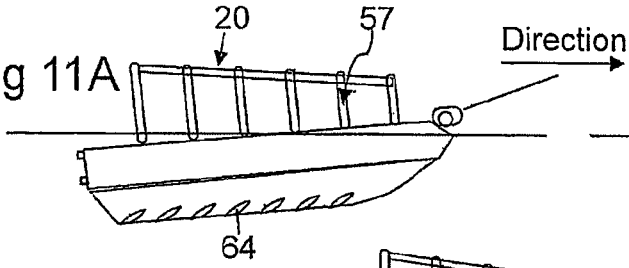
Figure 11B:
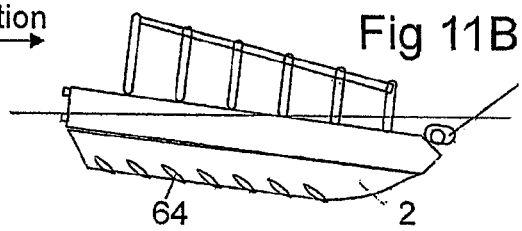
Figure 11C:
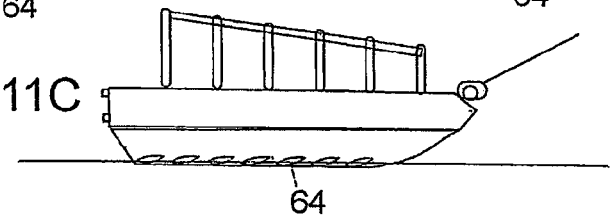
Figure 11D:
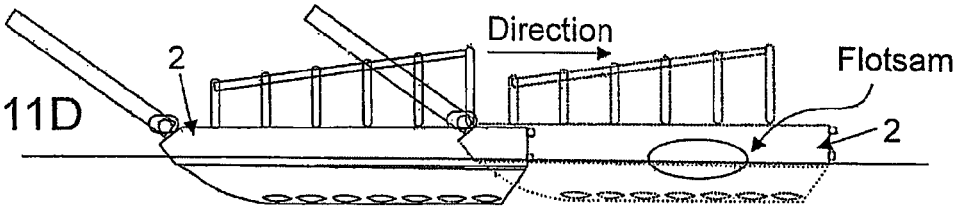
Figure 11E:
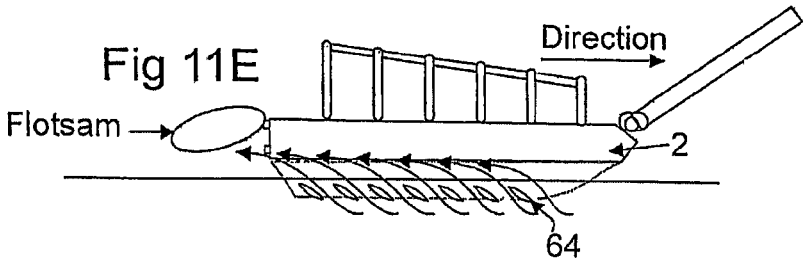

The marine handling craft 2 is designed to work in still, wavy or flowing water, regardless of whether the crane mechanism is fixed, or on a moving vessel, and regardless of the direction of the flowing water. The marine handling craft 2 is suitable for handling payloads to and from the water where the water is swiftly-flowing, and when the direction reverses, and when the level changes vertically, due to tidal or wave action, and whether the change is slow, such as a tidal flow, or rapid, such as waves or flash floods. The marine handling craft 2 can incorporate a variety of control surfaces which can, beyond vectoring the craft 2 or mother vessel 6, use water flow to remove unwanted materials and/or facilitate or deter boarding by craft or personnel, e.g. an alarm mode can divert water to "flush" the system as shown in FIG. 11E.

The use of the term "marine" for the marine handling craft, is not intended to imply that marine handling craft use is restricted to salt or fresh water handling of payloads including aquatic craft, or aquatic-borne cargo, living or inert. The marine handling craft can handle payloads acquired from land or the air. It has attributes, especially in advanced, stabilized embodiments, which make it suitable to deploy and recover e.g. small, unmanned helicopters from ships, as currently used by the US Navy. In most embodiments, the marine handling craft 2 is also functional when grounded, e.g. "parked" on the bottom or shore, semi or fully-submerged.

The marine handling craft is 2 configured to serve a forcing/guiding action when recovering vessels, both by the geometry of the marine handling craft 2 and by directing water flow.

Optional and innovative locking and unlocking mechanisms to secure the payload to the marine handling system may be used in all embodiments. FIGS. 6A and 6B show a representative locking and unlocking mechanism, which can be used to mechanically and electrically connect an auxiliary vehicle 4 to a marine handling craft in accordance with this invention. FIG. 6A shows a configuration in which a male locking member 42 on the auxiliary vessel 4 approaches a female locking member 44 on the marine handling craft 2. Female locking member 44 is positioned in the locking cavity 32 on the bow of the marine handling craft 2. The female locking member 44 is shown in the open position in FIG. 6A. When the male locking member 42 is advanced to a position shown in FIG. 6B, the female locking member 44 can be closed to surround the bulbous protrusion at the front of the male locking member 42. A flexible, sphincterate ring, or doughnut-shaped torus 35, is incorporated in the female locking member shown in FIGS. 6A and 6B. It can be closed by hydraulic or pneumatic pressure in a conventional manner, when contact is sensed by a transducer assembly 45. This sphincterate system, when constructed from flexible polymers, will for a hermetic seal for fluid transfers, like fuel or other desired fluids to be payloads. An alternate embodiment 6C would utilize an additional swelling ring in the male member, also inflated by conventional hydraulic or pneumatic means. Alternatively an electric motor could be employed to close locking member 44 around locking member 42. The two locking members 42 and 44 would preferably be modular so that "keyed" mateable locking members could be interchangeably mounted on two vessels 2 and 4. As shown in FIG. 2 a "cylindrical" cavity 32 would provide space for mounting one of the two locking members 42, 44, preferably the female locking member 44. With a keyed female locking member 44 mounted in cavity 32, only payloads having a male locking member 42 with a complementary keying configuration could be docked to the marine handling craft 2. Since the two vessels 2, 4 would be docked and locked at a stand off position sufficiently remote from the mother ship, security could be enhanced since it would become more difficult for unauthorized payloads to couple with the handling craft 2. FIG. 6D shows one example of keyed male and female locking members. Other sample geometric configurations are illustrated in FIG. 6E.

This aspect of the invention also can include a rapidly reconfigurable, remotely operated mating/docking/locking system, which can transmit data through optical windows or other transducer assemblies 45, e.g. transparent sapphire, and be shape coded, like a key, to receive almost any type of vessel or to repel entry. The mating/docking/locking system functions as a security system in addition to trapping and stowage. Additionally, the system is active or passive and is adjustable. While still remaining locked in place as undeployable, crewmen can adjust the vessel's attitude, allowing variable attitude of a constrained vessel by mechanical means, where the vehicle can be stowed, conveniently maintained and manipulated by technicians. The vectoring/forcing/repelling/mating/locking system may use air, hydraulics, electromagnetism, water pressure, vacuum or friction to control the vessel to be recovered.

Locking members 42 and 44 serve not only to mechanically secure the auxiliary vessel 4 to the marine handling craft 2, but they can also include fuel and electrical couplings between the two vessels. A data line 46 in the marine handling craft can be coupled to a data line 48 in the auxiliary vessel 4 by incorporating conventional matable push-pull electrical connectors in both of the locking members 42, 44. Similarly a fuel line 50 in the marine handling craft 2 can be coupled to a fuel line 52 in the auxiliary vessel by using conventional push-pull fluid couplings so that fuel can be transferred between the auxiliary vessel 4 and the marine handling craft 2. This fuel can be used to replenish tanks in either of the two vessels 2 and 4, or it can be used to transfer fuel to and from the mother ship 6 if a fuel line is provided between the marine handling craft 2 and the mother ship or boat 6. Such a fuel line would normally be suspended from the tether line 10 extending between the marine handling craft and the mother ship 6. In this configuration, the marine handling craft 2 and the auxiliary vessel 4 could comprise intermediate connection points for transferring fuel between two larger vessels. The marine handling craft 2 could be deployed from one ship and the auxiliary vessel could be deployed from another ship. The two vessels 2 and 4 would then mate and dock at an intermediate position and a fueling operation could then begin.

One alternate method of adjusting the lift point is using the power of the vessel to be recovered. If the mother ship's speed is exceeded by the craft to be recovered, the auxiliary docking craft forces the marine handling craft forward, the lift blocks may "ratchet" backwards and the CG lift point is achieved and maintained against a stop. On vessel deployment, a toggle engages the reverse process. When the marine handling craft and vessel contact the water, the lifting blocks ratchet forward to maximize vectors for the towing and releasing process.

The use of a marine handling craft 2 that can be tethered to individual cranes at various locations aboard the mother ship 6 will be desirable because of a number of factors affecting desired zones in which the vessels 2 and 4 are to be handled.

Command decisions will determine handling zones by criteria not limited to optimal wave and wind conditions. For a variety of reasons ranging from reducing the potential for collision to keeping potentially harmful payloads at a distance from a mother ship, it is often desirable to have a crane extended to a distance during a marine handling craft payload recovery process. Shown in FIG. 7 is an optimal recovery condition, where the mother 6 is underway. The marine handling craft 2 and the payload, in this case a supply vessel 4, are protected from wind and waves. Conditions vary however, and many factors will determine the desired handling zone, ranging from a tradeoff where wind is coming from one quarter and waves another, or it may be desirable to shelter the payload from shore view for security reasons.

The motion of crane and cable can also complicate deployment, recovery, towing, mating and docking of the vessels 2 and 4. A single point selected at the end of a crane 8 on a mother vessel 6 underway, if tracked over time, describes an undulating, irregular helix. The subtended volume of this helix is geometrically exacerbated as a function of the distance, squared, that the crane is extended from the mother. If the mother 6 is stopped, for example when docked or anchored, the point at the end of the crane might describe a bumpy sphere, as a function of the mother's roll, pitch and yaw, and as a function of the mechanical connections or slop in a preexisting standard crane on the mother ship 6. Cables of the type which might connect the marine handling craft to a crane are complex springs when extended, and have unusual characteristics in themselves.

Other complicating factors include the motion of marine handling craft 2 and payload or auxiliary vessel 4. The marine handling craft 2 and a vessel 4 to be deployed or recovered have substantially different mass, configuration, steering and power characteristics. Further, they will encounter substantially different wind and water conditions. With less mass than the mother ship, any fixed point on the marine handling craft 2 and auxiliary vessel 4 to be recovered will also describe undulating, irregular helixes with great variability. When out of the water, another set of variables is encountered in the air, and the aquatic control surfaces do not function.

A further complication is that the crane on the mother ship, the marine handling craft itself and the payload, if a vessel, may all be manned. Command decisions from the mother vessel's bridge may also be involved as a node in the network. Their different points of view and objectives may result in different steering and control decisions. The general desired objective is zero relative motion and may be to deploy a payload or to lock the marine handling craft, along with its payload, onto the deck.

Directional stability is required for the marine handling craft 2 under three distinct types of conditions. First, when the marine handling craft 2 is on the water's surface and the water is moving relative to the marine handling craft 4. This condition can occur when the marine handling craft 2 is towed by a mother 6, or when it is moored from a fixed position over moving water. Second, when the marine handling craft 2 is under water, as in recovering an autonomous underwater vehicle. Finally, directional stability is important when in the air.

The average attitude of the marine handling craft will be a horizontal plane, parallel to the earth's surface, or the water or a dock. It is very desirable to raise and lower the marine handling craft with a single line or umbilical for many reasons. The drawback is that payloads lifted by a single line tend to rotate on the lift axis, as a function of winds, and strain on non-braided cables, which are typically "handed" and attempt to unwind when stretched under strain. Enhancements to the invention to facilitate the recovery process are a gyroscope 37, mounted on the marine handling craft. To prevent rotation during lifting, a single gyroscope along one axis is sufficient. The system, without countermeasures, could spin, e.g. from wind, when lifted by cable only. The marine handling craft incorporates one or more gyroscopes, which stabilizes the marine handling craft both in the water and in the air, along desired axes.

The simpler embodiments of the marine handling system including a marine handling craft, matable and dockable with an auxiliary vessel or dock, can be controlled by personnel on the mother ship and/or on the marine handling craft 2 and the auxiliary vessel 4. However, in many applications it will be desirable to network the vessels for computer assisted or controlled mating and docking, as well as for verifying the integrity of the auxiliary vessel and its payload to enhance the security of the mother ship 6 and for any associated operations.

An advanced marine handling craft 2 can be self-propelled and smart, with an on-board computer. The auxiliary vessels that can then be handled by the marine handling craft can include, supply vessels, surface vessels, manned or unmanned, sub-surface, manned or unmanned, and small, unmanned air vehicles. Examples of networking are discussed with reference to FIGS. 8-10, which show an autonomous vehicle. Of course, manned auxiliary vessels, such as supply vessels, can be networked in a similar manner. The marine handling craft 2 is capable of being manually/computer-controlled from the handling platform itself, on board the mother vessel or any other location by human operators or autonomously, e.g. dry land or a dock, via encrypted, data handshaking and positioning software, which uses a variety of sensors between said craft and the vessel to be handled, or from any other remote computer.

The marine craft can be connected to an umbilical, which is capable of transmitting data or fuel or other materials from a mother to and from a subordinate vessel. These advanced marine handling craft, along with their sub-systems can be networked by wireless telemetry and may be operated from a mother vessel or helicopter, by personnel on board the marine handling craft, from a third craft to be handled, or, from a shore location. Computers on the marine handling craft network, whether operated by personnel, or operate autonomously and whether they are on the mother vessel, or elsewhere are referred to as "Clients". In some embodiments, the marine handling craft computer is the "Server". In other embodiments, a mother ship may be the server. The craft incorporates a variety of forward-looking sensors, which can serve to generate additional data for predictive programs to keep the handling portion of the system stable relative to the mother ship, the water, and the vessel, personnel or material to be recovered, or any other determined reference point, e.g. a relative but moving point below the surface of the water where movement is less than the movement at the water/air interface, as in recovering any payloads or objects of interest which are on the surface, submerged, or airborne.

The marine handling craft may operate in a mechanically-coupled, tethered or untethered mode. Structural components of the marine handling craft are also control surfaces, and function as a reconfigurable cradle. Control surfaces, we surfaces for imparting roll/pitch/yaw and x,y,z directions on or below the water's surface. The marine handling craft has the following six, somewhat constrained, degrees of freedom; roll, pitch, yaw, along its straight line track and x,y,z along its variable track, port, starboard and dive.

The craft can be "smart" and incorporates a computer and several sensors including, but not limited to: magnetometers, sonar, GPS, inertial, radiation, neutron activation/gamma backscatter, biological sensors and other devices such as GPS, inertial sensors, and optical/machine vision range finders, so that the craft "knows where it is", where the mother is, and where objects of interest are. The craft can include arrays of such sensors and an on-board computer with appropriate software and is capable of locating objects of interest using 3D vision within a certain distance from the system itself. The craft can be capable of utilizing on-board hardware and software to maximize data acquisition geometry from sensors at, above, or below the water's surface. To facilitate payload acquisition, the marine handling craft may be steered or "flown" by Clients, or autonomously by the marine handling craft server, as a function of processed sensor data. This craft is capable of interfacing with the helm of the mother vessel and, if required, for a payload of significance, it can control the helm (subject to human override) to facilitate recovery of an object of interest. In some embodiments, the craft's steering, shift and speed control may be mechanical, with a wheel and levers.

The uppermost structural components of the marine handling craft can serve as: sensor mounting locations; spray nozzle locations; and gyroscope 37 mounting, as well as to support a lifting and locking device. The lifting and locking device can be coupled and uncoupled, and is mechanically or autonomously adjustable for center of gravity (COG) and to maximize efficiency of towed operations in tethered mode.

The marine handling craft, when tethered or untethered can use dedicated computer software to optimize the payload acquisition, transfer, and unloading process. The optimization process is one of damping and orientation, where the spatial variability between marine handling craft and payload is minimized. Example factors affecting the orientation between a mother, marine handling craft, and payload are sea state, wind, and their relative motions as a primary function of their different sizes and masses.

Sensors for the relative position between the marine handling craft and vessel. would "look" at one or more axes. If the Mother is turning, it is desirable for the marine handling craft to turn at the same rate. "Heel" or roll may also need to be considered. Positioning sensors on board the marine handling craft supply data to the marine handling craft, functioning as a server, which distributes data to clients to facilitate the mating process. Positioning sensors include, but are not limited to, optical (video cameras), lasers, acoustic send/receive, and electromagnetic devices, e.g. radio direction finders, GPS antennas, magnetometers.

Level sensors are may be used by the marine handling craft and/or client to reduce strain on the mechanical lifting device. Strain sensors in the marine handling craft provide feedback to clients, prior to lifting. Sensors can also determine fore and aft weight distribution, rotation and weight, where a strain sensor serves as a scale.

The craft incorporates a variety of physical configuration and sensor/software security features can be incorporated to facilitate or repel docking or unauthorized boarding, which may be manually or computer-operated. Sensors for verifying the integrity of the payload or cargo can be included on the marine handling craft 2 and these sensors can be networked in the same manner as the control sensors. Conventional radiation, chemical, biological, X-ray backscatter, and neutron activation sensors can be incorporated and networked on the marine handling craft.

More complex versions of the marine handling craft integrate propulsion; remote and/or on-board steering; sensors; computer; gyroscopic stabilization for tag line elimination; trim tanks; fuel tanks; umbilical for, e.g. data, fuel and power, inspection devices, e.g. chemical sniffers, X ray devices, video cameras; data transfer devices, such as RFID tags; multi-function dive planes; registration targets and beams, such as reflectors (radar, light), lasers, sonars, etc.; mechanical "hard" coupling between the marine handling craft and a crane; locking and securing mechanisms, including both payload to marine handling craft and marine handling craft to crane; wake deflectors to assist registration; turbulence to smooth the water's surface; wheels and/or skids for ramp, beach and bank launch; GPS navigation; and custom software.

In advanced embodiments, the registration process will be computer controlled. Students of Chaos Theory might argue that it would be impossible to resolve this process by software. One might conclude that deconvoluting/projecting three chaotic, irregular helixes to a single point would require a supercomputer and constant re-calculation as new wind and water conditions are encountered. As a practical matter however, the general envelopes of mother ship, the marine handling craft and the auxiliary vessel to be recovered can be easily calculated and projected as a function of averaging. As the auxiliary vessel to be recovered approaches the effective physical 30 forcing area, a combination of the marine handling craft's physical shape, plus its wake can facilitate mating.

The marine handling craft is designed to be multi-purpose and modular to incorporate "bolt-on" devices. It has other uses such as: debris collection; fueling station; work platform; towing; sample collection. Sensors for hydrographics, acoustic, turbidity, salinity, pH, spectroscopy, and fuel transfer and storage could also be employed.

The marine handling craft can incorporate a computer and supplemental software that is capable of predicting conditions expected to be encountered to shorten mechanical response time and facilitate maneuvers. This supplemental software may be anywhere in a distributed computing network, e.g. on board the handling craft, on a mother-ship or a shore computer, which communicates vie telemetry.

Umbilicals, which supply power overboard from a mother, are expensive and problematic. They are not desirable where there are other options. The simplest marine handling craft would be a consumer product, and un-powered. In some cases it may not be hauled aboard a mother. It might be used as a towed storage system for an auxiliary vessel, such as a personal watercraft, where the mother wasn't large enough to carry a personal watercraft on board, like a motor home tows a small vehicle.

Embodiments of the marine handling craft can, however, include a drive system for propulsion and steering or operating in a tethered mode through the water. When operating independently or when stabilizing, this craft can be operated in a fixed or tethered mode from a boom. In most cases, marine handling craft use will be of short duration, like a unmanned surface vehicle recovery or a quick trip to shore and back to a mother. The marine handling craft can then be powered by using electric power and batteries contained in the marine handling craft. The advantages of electric operation are: simplicity, cost and reliability. In this case, the batteries would be recharged via the mother's electrical system when not in use, obviating an umbilical. Of course, self generation of power options, such as solar panels could be useful in more sophisticated embodiments Thrust on board the typical mother ship will be substantial. Electric motors on the marine handling craft, which consume power when turning propellers, can become generators when they are turned during the towing process. This process can provide power both to the marine handling craft and the payload. For many applications, this could be very significant. This process keeps a unmanned surface vehicle for example, electrically isolated from a mother and keeps batteries charged and supplies power to keep systems including computers, lights, telemetry operating to ensure that the towed vessels are ready to be deployed very quickly.

Electric power can be supplied topside supplied via umbilical between the mother ship and the marine handling craft. Electrical power supplied in this manner should be necessary only under special circumstances.

The marine handling craft according to this invention is not limited to the specific representative configurations depicted herein. For instance the stern-loading configurations depicted herein can be replaced by bow-loading, double-end loading, or side-loading configurations.

The marine handling craft can also be used for other purposes. The craft can be used to guide, trap and retrieve or deploy small vessels or materials or personnel. A net of varying mesh sizes and gauges can be suspended in the area between the pontoons and/or between the superstructure and pontoons. The varying mesh sizes and gauges are adjusted according to the intended application (a "classifying" function). Applications may be as diverse as recovering a man overboard, catching fish, scooping floating and submerged debris, lagan, flotsam and jetsam. The handling system is "fair" in the sense that it can ride over large debris and does not present surfaces that snag objects. The net is potentially sacrificial, and will part from the marine handling craft if desired capacities are exceeded.

Wing shaped finned control surfaces can extend at right angles between the two spaced pontoons and are configurable to flat for walking on by personnel or serve as dive planes and flushing/repelling mechanism, as shown in FIGS. 11A-E. The fins 64 overlap slightly, like a Venetian blind and rotate slightly less than 360 degrees. The primary functions of the fins are to support payloads [e.g. a standing surface for personnel, and to serve as control surfaces:

For a basic embodiment, the simplest application might be launching and recovering a personal water craft, such as a jet ski, from a yacht, where the water is calm and the yacht is stopped. An example is shown in FIGS. 13A-13C. The personal water craft operator drives into the marine handling craft, locks the device, and is lifted aboard by a conventional davit. If required, the personal water craft operator can adjust the CG with his own body as required.

In addition to transporting payloads, such as cargo, or autonomous auxiliary vessels, the marine handing craft can also be used to recover divers or swimmers as shown in FIG. 14. A net can be suspended between the two pontoons, and a diver or divers can enter or exit the marine handling craft on this net. A networked control panel 55 can be located on the marine handling craft permitting a diver to independently maneuver the marine handing craft. As shown by the three water levels WL-1, WL-2 and WL-3 in FIG. 14 the marine handling craft can operate in a floating, submersible or semi-submersible state. Of course a marine handling craft that can be maneuvered by a single occupant as shown in FIG. 14 will be smaller than a marine handling craft that can launch and recover a 35-foot auxiliary cargo vessel. The catamaran configuration with the overhead track permits such smaller craft to be stacked as shown in FIG. 15. Multiple marine handling craft can thus be stacked end to end for transport and storage. The net used in the configuration of FIG. 14 can be removed when these marine handling craft are stacked in this manner.

The control panel 55 shown in FIG. 16 permits the operator to steer and maneuver the marine handling craft in any direction, as well as to adjust the trim to permit submersible or semi-submersible operation. Data can be transmitted to the operator from sensors and transducers located on the marine handling craft as well as from other vessels networked to the marine handling craft. Representative sensors and transducers that can be mounted on the marine handling craft as shown in FIG. 17. The sensor array 56 mounted on the overhead track, the side struts as well as on the pontoons to surround the compartment in which an auxiliary vessel will be received as especially suited for inspection of the auxiliary vessel and its payload or of any articles that may be picked up by this craft. These sensors forming the array 56 need not all be the same type of sensor so that different environmental conditions or threats may be monitored. Representative examples of sensors that can be included in the array 56 include conventional radiation, chemical, biological, X-ray backscatter, and neutron activation sensors. Cameras 60 may also be mounted at various locations on the marine handling craft to visually monitor the contents of the marine handling craft. Equipment that can be used to neutralize potential threats, whether detected by the sensor array 56 or not, can also be mounted on the marine handling craft and are represented by sprayer units 61 disposed at strategic locations on the marine handling craft. These sensors and transducers and threat aversion equipment can be networked to an onboard computer 54 that is also networked to the primary platform, such as the computer 54A shown on the mother ship in FIG. 9, as well as to auxiliary vessels. The networked computer 54 can also serve to maneuver the marine handling craft since it is in communication with control surfaces 34 and propulsive systems 30 shown in FIG. 3 as well as trim and ballast tanks 53.

FIGS. 18 and 19 show one manner in which a marine handling craft can be employed with subsurface payloads other than auxiliary vessels. A cable reel 58 can be mounted on the marine handling craft between the two pontoons and a cable 59 can be deployed from the rear of the marine handling craft. This cable can be deployed to transfer or retrieve a payload attached at the end of the cable 59. A hoist 62 can also be mounted on the upper track of the marine handling craft to vertically deploy payloads to and from a subsurface platform, such as a submarine, or a subsurface structure, which could be part of an offshore oil platform. This configuration is merely representative of one of the many ways in which this marine handling craft can be employed.

FIG. 20 shows another example of a marine handling craft having robotic arms positioned on the craft 2 to manipulate payloads 5 carried, recovered or deployed by the marine handling craft 2.

This invention does not incorporate individual components that would require new materials or techniques beyond what is commercially-available. The craft is implementable now. The invention is open architecture oriented for computers, telemetry and software and can use standard fittings and modular, regularly spaced, redundant connector/fasteners. This invention is intentionally designed to receive third party enhancements, which would allow for upgrades, improvements, rapid repairs, web-connectivity, physical or computer-controlled rapid reconfiguration and obviating obsolescence. This craft incorporates modular connectors, modular open-architecture hardware and software and modular enclosures to accommodate a variety of hardware and software devices, whether proprietary or non-proprietary. This craft is also capable of incorporating third party analytical equipment into hermetically sealed modules and communication with wireless, hard, optical or other links to remote data bases for the purposes of cross-referencing objects or persons of interest with on-board sensor results.

We claim:

1. A marine handling craft tetherable to a mother vessel and dockable with a smaller marine vessel for raising and lowering the smaller vessel to and from the mother vessel, the marine handling craft including a track extending above a compartment into which the smaller vessel can enter and exit and at least one attachment block traveling along the track and attachable to a tether extending from the mother vessel so that the smaller vessel, when docked with the marine handling craft can be raised and lowered to and from the mother vessel.

2. The marine handling craft of claim 1 wherein the attachment block can be positioned above a combined center of gravity of the smaller vessel docked to the marine handling craft.

3. The marine handling craft of claim 2 wherein the position of the attachment block can be controlled from the smaller vessel.

4. The marine handling craft of claim 2 including a locking device for securing the smaller vessel to the marine handling craft.

5. The marine handling craft of claim 1 wherein the track extends from the bow of the marine handling craft aft above the compartment, and the attachment block travels from a position adjacent the bow of towing to a position above a combined center of gravity of the smaller vessel docked to the marine handling craft.

6. The marine handling craft of claim 1 wherein the marine handling craft includes buoyant members flanking the compartment in which the smaller vessel is received.

7. The marine handling draft of claim 1 wherein the marine handling craft includes an onboard computer programmed to maneuver the marine handling craft relative to the mother vessel.

8. The marine handling craft of claim 1 wherein the marine handling craft includes pontoons located on opposite sides of a compartment in which the smaller vessel can be docked to the marine handling craft, the buoyancy of the marine handling craft being adjustable for docking with smaller surface and subsurface vessels.

9. A marine handling craft for use in transferring payloads including cargo, supplies, equipment and personnel to and from a ship, the marine handling craft being deployable from the ship fore, aft and to either side of the ship, the marine handling craft including a track to which a tether can be fastened at different positions fore and aft on the marine handling craft to tether the marine handling craft to a single crane on the ship wherein attachment block means are traversable along the track, the attachment block means being attachable to the tether, the marine handling craft being dockable to and undockable from an auxiliary vessel so that when docked, the marine handling craft and the auxiliary vessel can be raised to and lowered from the ship by the single crane.

10. The marine handling craft of claim 9 wherein the track extends from the bow of the marine handling craft aft toward the stern of the marine handling craft, the track extending above a compartment into which the supply vessel is received for docking.

11. The marine handling craft of claim 9 wherein a tether is attachable at any location on the track corresponding to a position above a center of gravity of the marine handling craft docked to the supply vessel.

12. A marine handling craft for use with a primary platform and with an auxiliary vessel, the marine handling craft being deployable at a distance from the primary platform, wherein:

the marine handling craft is maneuverable relative to both the primary platform and to the auxiliary vessel and is mateable with the auxiliary vessel at a distance from the primary platform; and the marine handling craft includes electronic data communication apparatus, the marine handling craft transmitting and receiving data to and from the primary platform and the auxiliary vessel to facilitate mating and docking of the auxiliary vessel with the marine handling craft and to coordinate movement of the marine handling craft relative to the primary platform so that the auxiliary vessel can be deployed and captured by the marine handling craft at a distance from the primary platform.

13. The marine handling craft of claim 12 wherein the marine handling craft is maneuverable relative to a mother ship comprising the primary platform.

14. The marine handling craft of claim 12 wherein the marine handling craft is maneuverable relative to an aircraft comprising the primary platform.

15. The marine handling craft of claim 12 wherein the marine handling craft is maneuverable relative to a helicopter comprising the primary platform.

16. The marine handling craft of claim 12 wherein the marine handling craft is maneuverable relative to a dock comprising the primary platform.

17. The marine handling craft of claim 12 wherein the marine handling craft is maneuverable relative to a subsurface naval vessel comprising the primary platform.

18. The marine handling craft of claim 13 wherein the marine handling craft includes an onboard computer, electronically communicable with the mother ship and with the auxiliary vessel.

19. The marine handling craft of claim 18 wherein the computer onboard the marine handling craft is programmed to control relative movement of the marine handling craft, the auxiliary vessel and the mother ship.

20. The marine handling craft of claim 19 wherein sensors on the marine handling craft, communicable with the computer onboard the marine handling craft, monitor the relative positions of the marine handling craft, the auxiliary vessel and the mother ship.

21. The marine handling craft of claim 13 wherein the marine handling craft is powered for maneuverability independent of the mother ship and the auxiliary vessel.

22. The marine handling craft of claim 21 wherein the marine handling craft includes a detachable lock mateable with a complementary lock on the auxiliary vessel for docking the auxiliary vessel to the marine handling vessel.

23. The marine handling craft of claim 13 wherein the buoyancy of the marine handling craft is adjustable so that the marine handling craft can mate with surface and subsurface auxiliary vessels.

24. The marine handling craft of claim 13 including sensors on the marine handling craft for verifying the condition of payloads on the auxiliary vessel when mated to the marine handling craft at a standoff distance from the mother ship to prevent hazardous payloads from being brought too close to the mother ship.

25. A marine handling craft for use with a primary platform to load an object located in a body of water onto the primary platform, the marine handling craft being deployable at a stand off distance from the primary platform, wherein:

the marine handling craft is powered and maneuverable to position the marine handling craft at a stand off distance from the primary platform to which the marine handling craft is tethered and to capture the object at a stand off distance from the primary platform; and wherein the marine handling craft is recoverable by the primary platform only after electronic examination of the object and verification by the marine handling craft at the stand off distance that the object can be safely moved into closer proximity to the primary platform.

26. The marine handling craft of claim 25 wherein the primary platform comprises a mother ship.

27. The marine handling craft of claim 26 wherein the marine handling craft is configured to capture an auxiliary vessel comprising a floating object at a distance from the mother ship.

28. The marine handling craft of claim 27 wherein the marine handling craft includes a keyed locking member attachable to a complementary keyed locking member on the auxiliary vessel so that only auxiliary vessels including the complementary keyed locking member can be brought into proximity to the mother ship by the marine handling craft.

29. The marine handling craft of claim 27 wherein the marine handling craft includes sensors responsive to potentially dangerous contents on the auxiliary vessel for detecting potential hazards to the mother ship.

30. The marine handling craft of claim 26 wherein the marine handling craft is tetherable to the mother ship at the stand off distance.

31. The marine handling craft of claim 26 wherein the marine handling craft autonomously verifies at the stand off distance that the floating object can be safely moved into closer proximity to the mother ship.

32. The marine handling craft of claim 26 including an attachment member tetherable to the mother ship, the attachment member being shiftable closer to the combined center of gravity of the marine handling craft and the floating object, when the marine handling craft and the floating object are to be hoisted aboard the mother ship.

33. The marine handling craft of claim 26 wherein the marine handling craft is unmanned and is in electronic communication with the mother ship.

34. A marine handling craft for use in transferring payloads including cargo, supplies and personnel to and from a ship, the marine handling craft being deployable from the ship to mate with a supply vessel at a standoff distance from the ship, the marine handling craft being independently maneuverable relative to the ship to mate with the supply vessel and being dockable with the supply vessel to make the supply vessel fast to the marine handling craft, the marine handling craft including electronic sensors, located on the marine handling craft, responsive to potentially dangerous contents on the supply vessel for detecting potential hazards to the ship, the marine handling craft being tetherable to the ship and attachable to the ship so that the marine handling craft and the supply vessel can be coupled to and decoupled from the ship in unison to transfer cargo, supplies, and personnel between the supply vessel and the ship after a determination that the contents of the supply vessel are not dangerous to the ship.

35. The marine handling craft of claim 34 wherein the marine handling craft is attachable to a crane on the ship so that the marine handling craft and a supply vessel mated with the marine handling craft can be hoisted onto and lowered from the ship.

36. The marine handling craft of claim 35 wherein the marine handling craft includes a fastening member attachable to a tether and having a load bearing strength sufficient for lifting the marine handling craft and the supply vessel, when fully loaded, onto the ship so that the marine handling craft can be attached to a single crane on the ship, both for towing and lifting and deployment of the supply vessel.

37. A system for transferring fuel between first and second ships including:

a marine handling craft deployable from and tetherable to the first ship and an auxiliary vessel deployable from and tetherable to the second ship:

the marine handling craft being matable to the auxiliary vessel after deployment of the marine handling craft at a distance from the first ship and deployment of the auxiliary vessel at a distance from the second ship:

the marine handling craft including a handling craft locking member matable with an auxiliary vessel locking member, the marine handling craft locking member including a handling craft fuel line extending therethrough, the handling craft fuel line being alignable with an auxiliary vessel fuel line extending through the auxiliary handling craft locking member so that fuel can be transferred between the marine handling craft and the auxiliary vessel for transference between the first and second ships.

38. The system of claim 37 wherein the handling craft locking member includes a first data line couplable to second data line in the auxiliary vessel locking member so that data as well as fuel can be transferred through mated handling craft and auxiliary vessel locking members.

* * * * *